US005118085A

United States Patent [19]

Forte et al.

[11] Patent Number: 5,118,085

[45] Date of Patent: Jun. 2, 1992

[54] STEEL LADLE LIP CLOSURE APPARATUS

[75] Inventors: Gary L. Forte, Northville; Wayne Miller, Gibraltar, both of Mich.

[73] Assignee: AJF, Inc., Plymouth, Mich.

[21] Appl. No.: 678,233

[22] Filed: Apr. 1, 1991

[51] Int. Cl.[5] ..... C21C 5/44

[52] U.S. Cl. ..... 266/275; 266/246; 266/283; 266/286

[58] Field of Search ..... 266/246, 286, 275, 283

[56] References Cited

U.S. PATENT DOCUMENTS

| | | | |
|---|---|---|---|
| 3,552,732 | 1/1971 | Rice | 266/286 |
| 3,894,729 | 7/1975 | Muller | 266/43 |
| 4,366,255 | 12/1982 | Lankard | 501/95 |
| 4,569,508 | 2/1986 | de Graaf | 266/275 |
| 4,886,247 | 12/1989 | Hoffman et al. | 266/246 |
| 4,989,843 | 2/1991 | Dittrich et al. | 266/275 |

FOREIGN PATENT DOCUMENTS

| | | | |
|---|---|---|---|
| 26363 | 12/1967 | Japan | 266/283 |

*Primary Examiner*—Melvyn J. Andrews
*Attorney, Agent, or Firm*—Basile and Hanlon

[57] ABSTRACT

A lip closure apparatus includes a plurality of arcuate lip closure segments interfitted into a continuous ring and disposed on the top end of a stack of refractory bricks mounted in a metallurgical vessel. At least one metal reinforcement grid is disposed within each lip closure segment at a predetermined angle with respect to the normal fracture planes of each closure segment to resist fracture of the lip closure segment. Preferably, the grid is oriented substantially perpendicular to the normal fracture planes of the lip closure segments. A quantity of crushable material is disposed between the outer side surface of each lip closure segment and a flange extending at an angle from the side wall over the open top end of the vessel to maintain the lip closure segments in a tight fit on top of the lining of refractory bricks.

11 Claims, 2 Drawing Sheets

STEEL LADLE LIP CLOSURE APPARATUS

BACKGROUND OF THE INVENTION

1. Field of the Invention

The present invention relates, in general, to metallurgical vessels and, more specifically, to top ring or lip closure devices for metallurgical vessels, such as ladles used in the steel industry.

2. State of the Art

Metallurgical vessels, such as ladles used in the steel industry for handling molten steel, are formed of an outer steel shell and a refractory brick inner lining. The refractory bricks are stacked along the bottom surface and the inner surface of the steel shell along the entire height of the ladle from the bottom to the top, open mouth of the ladle.

Refractory bricks transfer a thermal load, i.e., heat radiation from the molten steel, from a "hot face" immediately adjacent the molten steel to a "cold face", i.e., the refractory plane most distant from the molten metal and located adjacent to the outer steel shell. During steelmaking, the ladle is frequently tipped for steel pouring or slag skimming operations and completely upended for deslagging. In order to provide mechanical support for the refractory brick stack, it is known to form an inwardly extending, angled flange immediately adjacent the top end of the steel shell. A removable lip ring or lip closure ring is inserted inside of the flange and on top of the refractory brick stack. The lip closure ring is typically formed of a number of identical, arcuate segments cast from a refractory or ceramic material. A smaller segment or "key" is custom shaped and inserted between two adjacent segments to close the lip ring and to provide integrity in the ring to support the refractory brick stack.

Some types of lip rings or lip closures use bolts to secure the lip ring segments to the outer steel shell. However, the bolts tend to break under mechanical forces generated by irreversible expansion and are not as favored as the angled closure flange and lip closure ring described above.

All such metallurgical vessels have a maximum service life limit before the refractory bricks must be replaced. Such a limit, which can be from twenty to twenty-five heats of molten steel, is determined in part by the life of the refractory bricks which are continually consumed by the repeated thermal transfer cycles of heat from the molten steel to the outer shell. Further, the service life limit is effected by the expansion of the refractory bricks from their original cold-cure state during initial burn in and the first few heats. Most of the expansion, which can be as much as 2½ inches over the entire height of the refractory brick stack, occurs during the first few heats and remains constant thereafter for the service life of the brick stack. This expansion exerts a considerable force on the lip closure ring which can cause deformation, warpage or even breakage of the ring and thereby reduce or limit the useful service life of the vessel.

Thus, it would be desirable to provide a lip closure ring apparatus which overcomes the problems encountered with previously constructed lip closure rings. It would also be desirable to provide a lip closure ring apparatus which resists deformation despite thermal expansion of a refractory brick stack. It would also be desirable to provide a lip closure ring apparatus which increases the useful service life of a metallurgical vessel.

SUMMARY OF THE INVENTION

The present invention is a lip closure apparatus for a metallurgical vessel, such as a steel ladle, having a bottom, a side wall, an open, top end opposite from the bottom, and an inner lining of refractory bricks covering the bottom and the side wall.

The lip closure apparatus comprises a flange mounted on the vessel adjacent the top end thereof which extends inward at a predetermined angle from the side wall of the vessel. A plurality of arcuate lip closure segments, each having an inclined outer face complimentary to the angle of the flange, are interfitted into a continuous lip closure ring interiorly of the flange and overlying the top end of the inner lining of the refractory bricks to retain the inner lining of refractory bricks in a fixed position within the vessel.

At least one, planar, metal reinforcement grid is disposed in each arcuate segment at a predetermined angle with respect to the planar bottom of each arcuate segment. The reinforcement grid comprises a metallic mesh which is preferably cast in place with each arcuate segment. In a preferred embodiment, two, planar, reinforcement grids are disposed in a spaced-apart arrangement in each arcuate segment. The grid or grids are disposed substantially perpendicular to the normal fracture or spall planes of each arcuate segment. The reinforcement grid or grids add strength to each arcuate segment and resist fracture of the arcuate segments caused by mechanical forces exerted on the arcuate segments during thermal expansion of the inner liner of refractory bricks during use of the metallurgical vessel.

In another embodiment, which may be employed by itself or in combination with the reinforcement grid(s), a quantity of crushable material is disposed between the angled outer face of each arcuate lip closure segment and the flange on the vessel to allow for irreversible expansion of the inner lining of refractory bricks with respect to the flange, but to maintain the arcuate segments in a tight fit on the inner lining of refractory bricks.

The lip closure apparatus of the present invention solves several problems existing with previously devised lip closure apparatus for metallurgical vessels, such as steel ladles. The use of one or more metal reinforcement grids in each castable lip closure segment provides additional strength to each closure segment which resists fracture of such segments under mechanical forces exerted on the segments during thermal expansion of the refractory brick lining in the vessel. The reinforcement grids are cast in place during the casting of each lip closure segment and are disposed at a predetermined angle, preferably, substantially perpendicular to the normal fracture planes of each segment to provide maximum reinforcement and strength to each segment.

The present invention also employs a crushable material between the outer face of the lip closure segments and the inclined flange at the open, top end of the vessel. The crushable material allows for normal expansion of the inner lining of refractory bricks and the resulting upward movement of the lip closure ring while maintaining the lip closure ring in tight contact with the top of the inner lining of refractory bricks.

The metal reinforcement grids and the crushable material disposed between the closure segment and the vessel top end flange may be used in combination with each other for maximum strength and fracture resistance.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
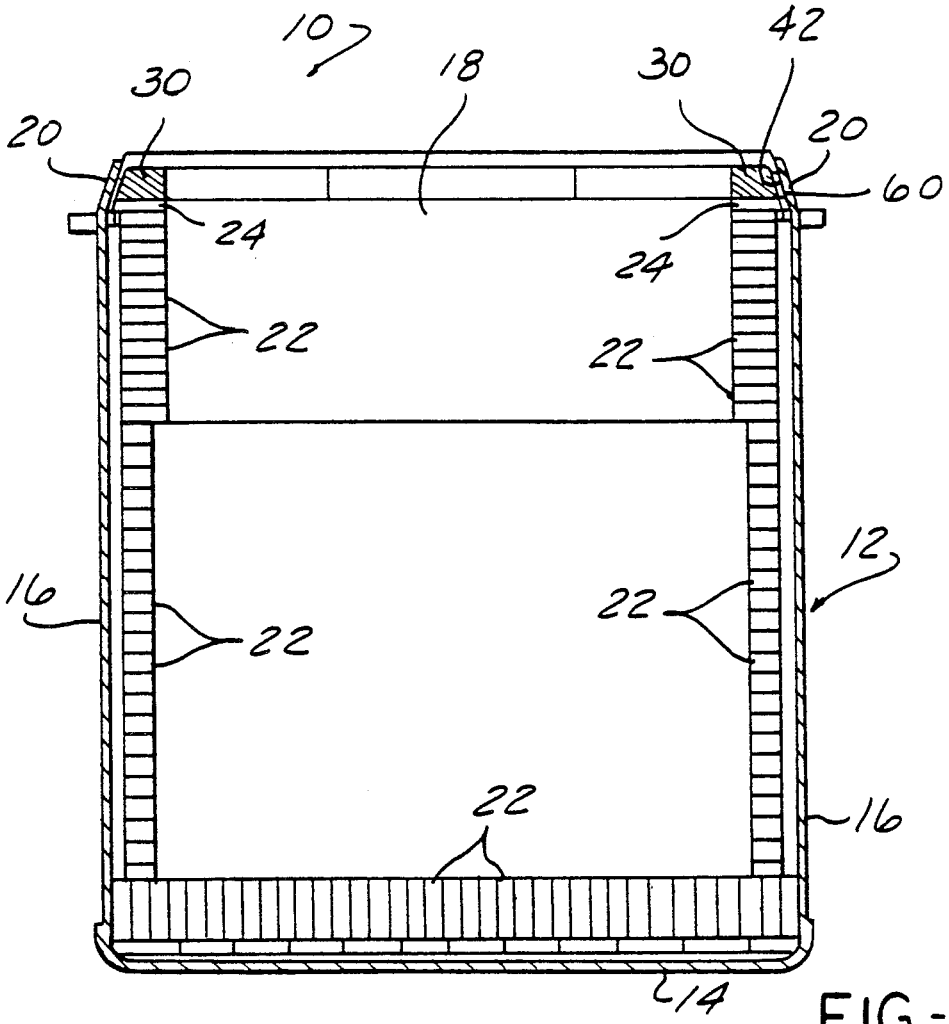
FIG. 1 is a cross sectional view through a metallurgical vessel, such as a steel ladle, showing the lip closure apparatus of the present invention mounted therein.

Referring now to the drawing, and to FIG. 1 in particular, there is illustrated a conventional metallurgical vessel, such as a steel ladle used in the steelmaking industry.

The ladle 10 comprises a conventional outer shell 12 formed of steel. The outer shell 12 includes a bottom wall 14, a side wall 16 and an open, top end opposed from the bottom wall 14 and denoted by reference number 18.

A flange 20 is mounted to the outer shell 12 of the ladle 10 and is disposed at an inwardly extending angle with respect to the substantially vertical side wall 16. Preferably, the flange 20 is disposed at a 15° angle from the vertical with respect to the vertical side wall and extends completely around the open top end 18 of the ladle 10.

A lining of refractory bricks 22 is disposed along the bottom wall 14 and the side wall 16 of the ladle 10 to completely line the interior of the ladle 10. As is conventional, the refractory bricks 22 may be formed of any suitable refractory material. The refractory bricks 22 transfer heat from the molten steel outward to the outer shell 12 of the ladle 10. The inner lining of refractory bricks 22 is in the form of a stack in which the bricks 22 are joined together by suitable mortar or cement. The uppermost bricks 24 in the stack form a continuous ring about the open top end 18 of the ladle 10.

Figure 2:
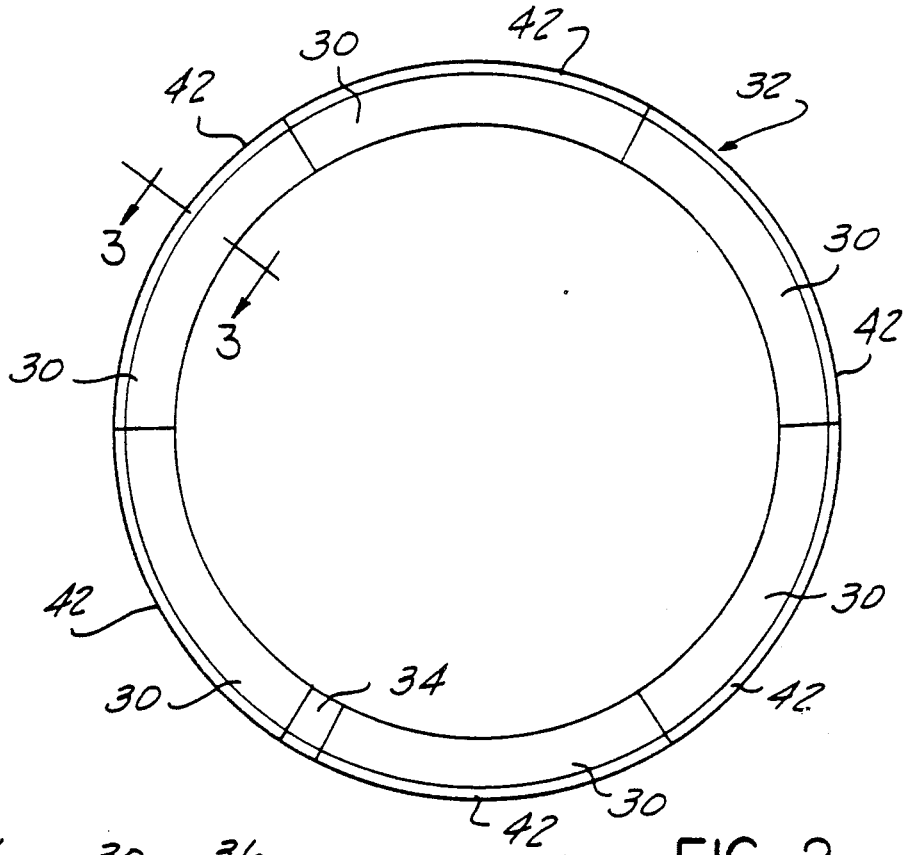
FIG. 2 is a plan view of the lip closure ring of the apparatus of the present invention.

As it is known that the refractory bricks 22 expand during heat transfer from the molten steel to the shell 12 of the ladle 10, a lip closure apparatus is disposed on top of the topmost refractory bricks 24 in the inner lining of refractory bricks 22 adjacent the inclined flange 20 at the open top end 18 of the ladle 10. As shown in FIG. 1, and in greater detail in FIGS. 2 and 3, the lip closure apparatus includes a plurality of substantially identical, arcuate lip closure segments 30 which are interconnected into a continuous lip closure ring denoted in general by reference number 32. A smaller, custom made, final segment or "key" 34 is fit between two adjacent, spaced segments 30 to complete the lip closure ring 32 and to form the arcuate lip closure segments 30 and 34 into a continuous, interfitting ring.

In mounting the lip closure apparatus on the stack of bricks, a thin coat of mortar is applied over the top of the uppermost bricks 24 to fill any gaps between the bricks 24 and the lip closure apparatus. After each segment 30 is mounted on top of the uppermost ring of bricks 24, the key segment 34 is cut to size and inserted between the spaced ends of two adjacent segments 30 to complete the ring. A phosphate bond, high alumina ramming mix is then inserted between the outer face of the key segment 34 and the shell 12.

Figure 3:
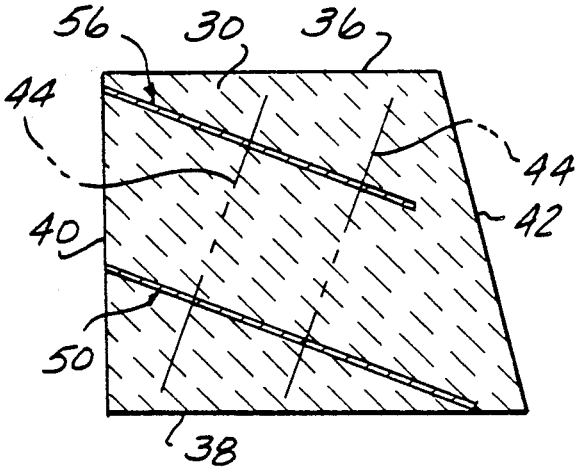
FIG. 3 is a cross sectional view generally taken along line 3—3 in FIG. 2.
Figure 5:
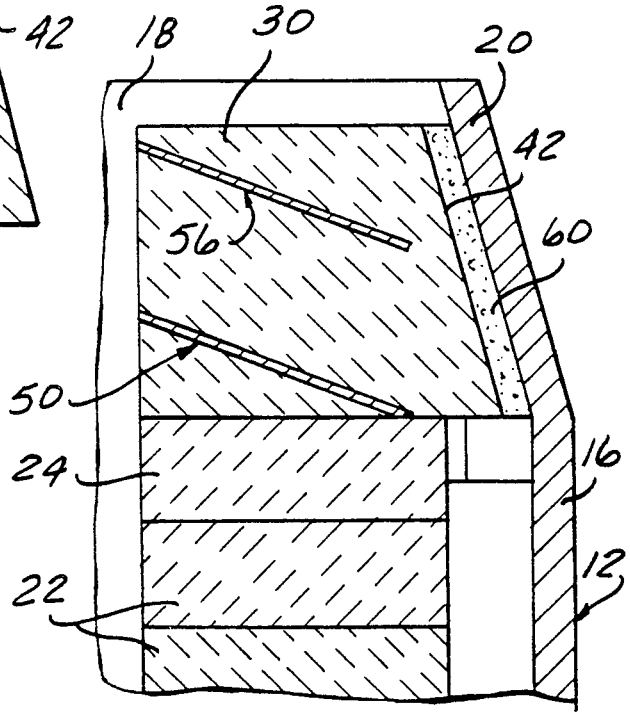
FIG. 5 is a partial, enlarged, cross sectional view through the upper end of the metallurgical vessel showing another embodiment of the present invention.

As shown more clearly in FIG. 3, each of the lip closure segments 30 and, also, the key segment 34 is formed with substantially planar, spaced top surface 36 and bottom surface 38. A perpendicular inner wall 40 extends between the top surface 36 and the bottom surface 38. An outer wall 42 also extends between the top surface 36 and the bottom surface 38. However, the outer wall 42 of each closure segment 30 is disposed at a predetermined angle from vertical. The angle is selected so as to make the outer surface 42 of each closure segment 30 complimentary to the 15° angle of the flange 20 at the open top end 18 of the ladle 10, as shown in FIGS. 1 and 5. The outer wall of the key segment 34 is perpendicular to the top surface 36 and bottom surface 38 to allow insertion of the key segment 34 through the open top of the outer shell 12.

Each lip closure segment 30 and 34 is conventionally formed of a suitable refractory material, such as a magnesia or alumina castable, refractory material.

As is further known, such castable closure segments 30 are subject to fracture along a series of fracture or spall planes 44, typically at a 65° to 75° acute angle from the bottom surface 38 in FIG. 3. Such fracture typically results from mechanical forces exerted on the lip closure segments 30 by thermal stresses present during the heat-up and cool-down of the refractory bricks 22.

According to the present invention, at least one, planar, metal reinforcement grid 50 is disposed within each lip closure segment 30 at a predetermined angle with respect to the bottom surface 38 of each segment 30. The metal reinforcement grid 50 is formed of a suitable high strength metal, such as steel. The grid 50 can be formed in any suitable manner, such as a screen or as an expanded metal mesh formed of interconnected, spaced, thin diameter metal strips. Further, the grid 50 is integrally formed in each lip closure segment 30 during the casting of each lip closure segment 30. The grid 50 is disposed at a predetermined angle, which is preferably substantially perpendicular to the normal fracture plane or planes 44 in each lip closure segment 30. This provides maximum strength to resist fracture of each closure lip segment 30 along the fracture planes 44.

Figure 4A:
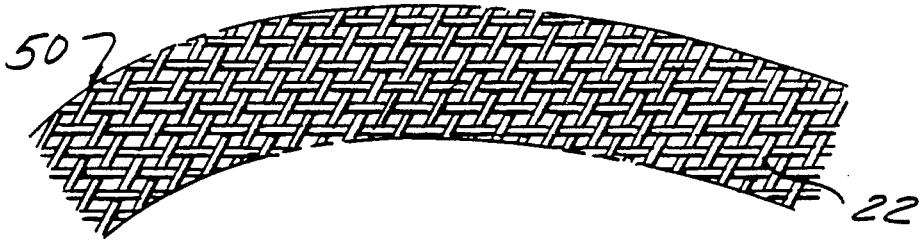
FIGS. 4A and 4B are plan views of the metal reinforcement grids employed in each lip closure segment shown in FIGS. 2 and 3.
Figure 4B:
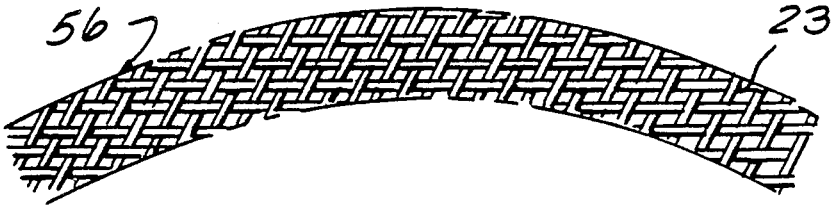

Preferably, a plurality of reinforcement grids are mounted in each lip closure segment 30. In one embodiment, a second, planar, reinforcement grid 56 is disposed in each closure segment 30 and is spaced from the first grid 50, as shown in FIG. 3. The second grid 56, as shown in FIGS. 3 and 4B is formed in the same manner as the first grid 50; but has a somewhat smaller width and length than the first grid 50. The second grid 56 is also integrally formed with each lip closure segment 30 during the casting of each lip closure segment 30.

Although the metal reinforcing grids 50 and 56 have been described as being disposed substantially perpendicular to the fracture planes 44 in each lip closure segment 30, it will be understood that the grids 50 and 56 may be disposed at other angles, such as between 80° and 110° with respect to the fracture planes 44.

According to another embodiment of the present invention, as shown in FIG. 1, and in greater detail in FIG. 5, a quantity of crushable material 60 is disposed between the outer face 42 of each lip closure segment 30 and the inner surface of the flange 20 of the ladle 10. The crushable material 60 may be formed of any particulate, such as crushable aggregate backfill material, suitable for high temperature applications. Such material is provided in various sizes, such as from ¼ inch to one inch diameter, and is porous so as to be crushable under mechanical forces resulting from the irreversible expansion of the refractory bricks 22 which cause an upward movement of the lip closure ring 32, as described above. During such irreversible expansion of the refractory bricks 22 and the upward movement of the lip closure ring 32, the forces will cause the particulate material 60 to crush and compact thereby maintaining the lip closure ring 32 in a tight fit on top of the stack of refractory bricks 22. Such a fit extends completely around the entire diameter of the ladle 10.

The crushable material 60 may be provided in a variety of forms. Particulate material can be poured in loose form between the lip closure ring 32 and the flange 20. Alternately, cement, such as sodium silicate and water, can be mixed with the particulate material and allowed to set to a hardened state after being poured behind the lip closure ring 32. Further, only a top layer of the particulate material can be mixed with cement and water to form a cap which retains the particulate material in place while still providing the desired crushable features. Finally, the crushable material may be preformed into a fiber-like sheet and mounted on the outer wall 42 of each segment 30 before the segment 30 is mounted in the shell 12.

In summary, there has been disclosed a unique lip closure apparatus for a metallurgical vessel, such as a steel ladle, which overcomes several of the problems existent with previously devised lip closure apparatus. The lip closure apparatus of the present invention uniquely includes at least one and preferably a plurality of spaced, metal reinforcement grids which are disposed interiorly within each arcuate lip closure segment. The reinforcement grids add strength to each closure segment and resist fracture of each closure segment along normal fracture planes. The lip closure apparatus, in another embodiment, also includes a crushable material between the outer surface of each lip closure segment and the inwardly extending, angular flange at the top end of the ladle. This crushable material compacts during upward movement of the lip closure ring caused by irreversible expansion of the inner lining of refractory bricks so as to maintain the lip closure ring in a tight, even fit about the top end of the stack or lining of refractory bricks.

What is claimed is:

1. A lip closure apparatus for a metallurgical vessel having a bottom, a side wall and an open, top end opposite from the bottom, an inner lining of refractory brick covering the side wall of the vessel, the lip closure apparatus comprising:

a flange mounted on the vessel adjacent the top end and extending angularly inward from the side wall of the vessel;

a plurality of arcuate lip closure segments, each having an inclined outer face complimentary to the angle of the flange, the plurality of arcuate segments interfitted into a continuous ring interiorly of the flange and overlying the inner lining of the refractory bricks to retain the inner lining of refractory bricks in position in the vessel; and a planar, metal reinforcement grid disposed in each lip closure segment at an angle with respect to the fracture planes of each lip closure segment.

2. The lip closure apparatus of claim 1 wherein two spaced, planar, metallic reinforcement grids are disposed in each lip closure segment at identical angles with respect to the fracture planes of each lip closure segment.

3. The lip closure apparatus of claim 1 wherein the grid comprises:

a plurality of thin metal strips interconnected into an open mesh.

4. The lip closure apparatus of claim 1 wherein the grid has a planar, arcuate shape complimentary to the shape of the associated lip closure segment.

5. The lip closure apparatus of claim 1 wherein the grid is disposed substantially perpendicular to the fracture planes of each lip closure segment.

6. The lip closure apparatus of claim further comprising:

a quantity of crushable material disposed between the outer face of each lip closure segment and the flange to allow for expansion of the inner lining of refractory bricks with respect to the flange.

7. A lip closure apparatus for a metallurgical vessel having a bottom, a side wall and an open, top end opposite from the bottom, an inner lining of refractory brick covering the side wall of the vessel, the lip closure apparatus comprising:

a flange mounted on the vessel adjacent the top end and extending angularly inward from the side wall of the vessel;

a plurality of arcuate lip closure segments, each having an inclined outer face complimentary to the angle of the flange, the plurality of arcuate segments interfitted into a continuous ring interiorly of the flange and overlying the inner lining of the refractory bricks to retain the inner lining of refractory bricks in position in the vessel;

two, spaced, planar metallic reinforcement grids disposed in each lip closure segment substantially perpendicular to the fracture planes of each lip closure segment, each grid comprising a plurality of thin, metal strips interconnected into an open mesh, the mesh having a planar, arcuate shape complimentary to the shape of the associated lip closure segment; and a quantity of crushable material disposed between the outer face of each lip closure segment and the flange to allow for expansion of the inner lining of refractory bricks with respect to the flange.

8. A lip closure apparatus for a metallurgical vessel having a bottom, a side wall and an open, top end opposite from the bottom, an inner lining of refractory brick covering the side wall of the vessel, the lip closure apparatus comprising:

a flange mounted on the vessel adjacent the top end and extending angularly inward from the side wall of the vessel;

a plurality of arcuate lip closure segments, each having an inclined outer face complimentary to the angle of the flange, the plurality of arcuate segments interfitted into a continuous ring interiorly of the flange and overlying the inner lining of the refractory bricks to retain the inner lining of refractory bricks in position in the vessel; and a quantity of crushable material disposed between the outer face of each lip closure segment and the flange to allow for expansion of the inner lining of refractory bricks with respect to the flange.

9. The lip closure apparatus of claim 8 wherein the crushable material is a particulate material.

10. The lip closure apparatus of claim 9 wherein a settable binder is mixed with the particulate, crushable material.

11. The lip closure apparatus of claim 1 wherein the grid is disposed at an angle substantially between 80° and 110° to the fracture planes of each lip closure segment.

* * * * *